US009444171B1

(12) United States Patent
LI

(10) Patent No.: US 9,444,171 B1
(45) Date of Patent: Sep. 13, 2016

(54) FAST WIRE CONNECTOR

(71) Applicant: Chien-Chang LI, Kaohsiung (TW)

(72) Inventor: Chien-Chang LI, Kaohsiung (TW)

( * ) Notice: Subject to any disclaimer, the term of this patent is extended or adjusted under 35 U.S.C. 154(b) by 0 days.

(21) Appl. No.: 14/872,124

(22) Filed: Sep. 30, 2015

(51) Int. Cl.
*H01R 13/40* (2006.01)
*H01R 13/42* (2006.01)

(52) U.S. Cl.
CPC ..... *H01R 13/42* (2013.01)

(58) Field of Classification Search
CPC ..... H01R 13/42
USPC ..... 439/733.1
See application file for complete search history.

(56) References Cited

U.S. PATENT DOCUMENTS 7,255,592 B1 * 8/2007 Tseng ..... H01R 4/22 439/439

* cited by examiner

*Primary Examiner* — Javaid Nasri
(74) *Attorney, Agent, or Firm* — Hershkovitz & Associates, PLLC; Abraham Hershkovitz

(57) ABSTRACT

A fast wire connector includes a body and a conductive sheet. At least one connecting space, a top housing chamber and a bottom housing chamber are formed within the body. The at least one connecting space includes a top hole, a bottom hole and a housing chamber. The conductive sheet is disposed within the housing chamber and bended at two ends to form at least one top contact portion, at least one bottom contact portion, a top bending portion and a bottom bending portion. The top and bottom bending portions are respectively inserted into the top housing space and the bottom housing space. The top and bottom contact portions contact an inner surface of the body. Two elongate through-holes are respectively disposed on positions of the front side surface of the body corresponding to the top contact portion and the bottom contact portion.

20 Claims, 12 Drawing Sheets

FAST WIRE CONNECTOR

BACKGROUND OF THE INVENTION

1. Field of the Invention

The present invention relates to a wire connector, and more particularly relates to a fast wire connector capable of assembling or disassembling two electrical wires.

2. Description of the Related Art

In the conventional technique, two electrical wires can be connected by using a connector. Two ends of the connector respectively include a top hole and a bottom hole, and an interior of the connector includes a metal spring plate. Two conductive portions respectively disposed at a front end of each of the two electrical wires are plugged into the top hole and the bottom hole. After the two electrical wires are plugged into the top hole and the bottom hole, the conductive portions of the electrical wires are held by the metal spring plate and an inner surface of the connector to achieve an electrical connection between the conductive portions of the electrical wires and the metal spring plate. However, the size of the connector is small, and a length of the top hole or the bottom hole is limited. Therefore, after the electrical wire is plugged into the top hole or the bottom hole, the conductive portion of the electrical wire may be still exposed outside of the connector to cause power leakage or risk of electric shock. Moreover, the connector can fast connect the two electrical wires, but it is inconvenient to disassemble the electrical wires from the connector. The connector is required to be torn apart to disassemble the electrical wire and time is wasted. Therefore, to design an apparatus capable of quickly assembling or disassembling the two electrical wires is a significant issue in the conventional electronic devices.

SUMMARY OF THE INVENTION

In accordance with the aforementioned problems, a fast wire connector is provided in the present invention to solve the problems in the conventional technique.

To achieve the foregoing objective, the present invention provides a fast wire connector adapted to be connected with at least two electrical wires and each one of the at least two electrical wires including an insulating portion covering an exterior of a conductive wire and a wire conductor insulated by the insulating portion, the wire conductor having a terminal as a conductive portion uncovered by the insulating portion, the fast wire connector comprising:

a body being a hollow body and including:

a top surface and a bottom surface disposed at two ends of the body;

a front side surface and a rear side surface disposed at two sides of the body;

at least one connecting space having:

a top hole and a bottom hole respectively formed through the top surface and the bottom surface; and a housing chamber communicating with the top hole and the bottom hole; and at least one top housing chamber and at least one bottom housing chamber respectively adjacent to the top surface and the bottom surface, wherein the at least one connecting space, the at least one top housing chamber, and the at least one bottom housing chamber are formed within the body; and a conductive sheet disposed within the housing chamber at each of the at least one connecting space and sequentially forming at least one top contact portion, a top bending portion, a bottom bending portion, and at least one bottom contact portion;

the at least one top contact portion connected with the top bending portion;

the at least one bottom contact portion connected with the bottom bending portion;

the top bending portion inserted into the at least one top housing chamber and contacting an inner surface of the body;

the bottom bending portion inserted into the bottom space and contacting the inner surface of the body; and the at least one top contact portion and the at least one bottom contact portion inserted into the inner surface of the body;

wherein an elongate through-hole is formed and extended on the front side surface at a position corresponding to the at least one top contact portion and another elongate through-hole is formed and extended on the front side surface at a position corresponding to the at least one bottom contact portion.

In the fast wire connector, the body includes a first assembly and a second assembly capable of being connected to each other, the first assembly is a shell, and the second assembly is a cover.

In the fast wire connector, the at least one connecting space is formed between the shell and the cover, and the front side surface is included in the shell and the rear side surface is included in the cover.

In the fast wire connector, two passing holes are formed on the front side surface, the two passing holes are respectively formed through the first assembly, and two assembling components are formed on the rear side surface respectively corresponding to the two passing holes.

In the fast wire connector, the body includes a first assembly, a second assembly and a third assembly, and the at least one connecting space is formed between the first assembly and the second assembly and between the second assembly and the third assembly.

In the fast wire connector, a curved through-hole is formed on the third assembly and is corresponding to a shape of the conductive sheet, and the conductive sheet is mounted through the curved through-hole.

In the fast wire connector, the at least one top contact portion includes a first top contact portion and a second top contact portion, and the at least one bottom contact portion includes a first bottom contact portion and a second bottom contact portion.

In the fast wire connector, the first top contact portion and the first bottom contact portion are disposed within the housing chamber of the connecting space between the first assembly and the third assembly and contacts the inner surface of the first assembly, and the second top contact portion and the second bottom contact portion are disposed within the housing chamber of the connecting space between the second assembly and the third assembly and contacts the inner surface of the second assembly.

In the fast wire connector, the rear side surface is included in the second assembly and an elongate through-hole is formed and extended on the rear side surface at a position corresponding to the second top contact portion and another elongate through-hole is formed and extended on the rear side surface at a position corresponding to the second bottom contact portion.

In the fast wire connector, the body includes a first assembly, a second assembly, a third assembly and a fourth assembly, and the at least one connecting space is formed between the first assembly and the third assembly, between the second assembly and the fourth assembly, and between the third assembly and the fourth assembly.

In the fast wire connector, a curved through-hole is formed at each of the third assembly and the fourth assembly and is corresponding to a shape of the conductive sheet.

In the fast wire connector, the at least one top contact portion includes a first top contact portion, a second top contact portion and a third top contact portion, and the at least one bottom contact portion includes a first bottom contact portion, a second bottom contact portion and a third bottom contact portion.

In the fast wire connector, the first top contact portion and the first bottom contact portion are disposed within the housing chamber of the connecting space between the first assembly and the third assembly and contacts the inner surface of the first assembly, the second top contact portion and the second bottom contact portion are disposed within the housing chamber of the connecting space between the third assembly and the fourth assembly and contacts the inner surface of the fourth assembly, and the third top contact portion and the third bottom contact portion are disposed within the housing chamber of the connecting space between the second assembly and the fourth assembly and contacts the inner surface of the second assembly.

In the fast wire connector, the rear side surface is included in the second assembly and an elongate through-hole is formed and extended on the rear side surface at a position corresponding to the third top contact portion, another elongate through-hole is formed and extended on the rear side surface at a position corresponding to the third bottom contact portion.

In the fast wire connector, the at least one connecting space, the top housing chamber and the bottom housing chamber are formed within the first assembly and the second assembly.

In the fast wire connector, two stopper portions are formed on the inner surface of the body adjacent to the top housing chamber and the bottom housing chamber respectively.

In the fast wire connector, the two stopper portions form two stopper surfaces respectively corresponding to the top hole and the bottom hole, and the electrical wire is plugged into the top hole or the bottom hole and the conductive portion of the wire contacts the corresponding stopper surface of the stopper portion.

In the fast wire connector, a front end of the at least one contact portion and the inner surface together hold the conductive portion of the electrical wire, and a portion of the insulating portion is disposed within the housing chamber and a length of the portion of the insulating portion is greater than 4 mm.

In the fast wire connector, the front side surface is included in the first assembly and forms two passing holes, the two passing holes are respectively formed through the first assembly, and the rear side surface forms two assembling components respectively corresponding to the two passing holes.

In the fast wire connector, the body further includes a left side surface and a right side surface, the left side surface and the right side surface are disposed at two sides of the body between the front side surface and the rear side surface, a dovetail joint is formed on the left side surface, and a dovetail slot is formed on the right side surface.

The two elongate through-holes are formed on the front side surface of the body corresponding to the conductive sheet in the present invention. After a pencil-like tool is inserted into a top edge of the top elongate through-hole and moves downward, a front end of the pencil-like tool presses down the top contact portion to release the front end of the top contact portion from the inner surface of the body and remove the electrical wire. Therefore, the purpose to fast dissemble the electrical wire is achieved. In addition, a certain length exists between a stopper portion and the corresponding top hole or the bottom hole to let a portion of the insulating portion of the electrical wire be disposed within the housing chamber. Therefore, when the electrical wire is used in the present invention, the conductive portion is not exposed outside of the housing chamber to cause power leakage problem. Therefore, the present invention solves the problems of wire dissembling difficulty and power leakage in the conventional art. In addition, multiple connecting spaces are formed in the body to accommodate the electrical wires inserted into the top hole and the corresponding bottom hole for the connection of the circuits.

DETAILED DESCRIPTION OF THE INVENTION

These and other aspects of the embodiments herein will be better appreciated and understood when considered in conjunction with the following description and the accompanying drawings.

Figure 1:
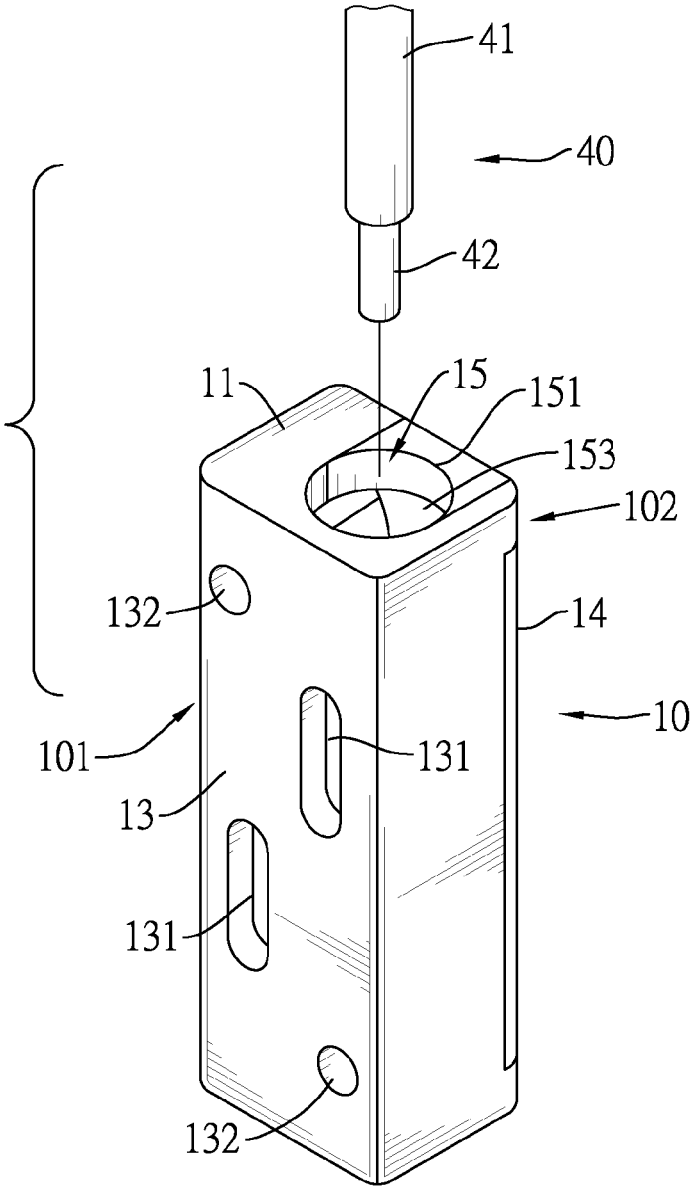
FIG. 1 is a perspective view of a fast wire connector in a first embodiment of the present invention.
Figure 3:
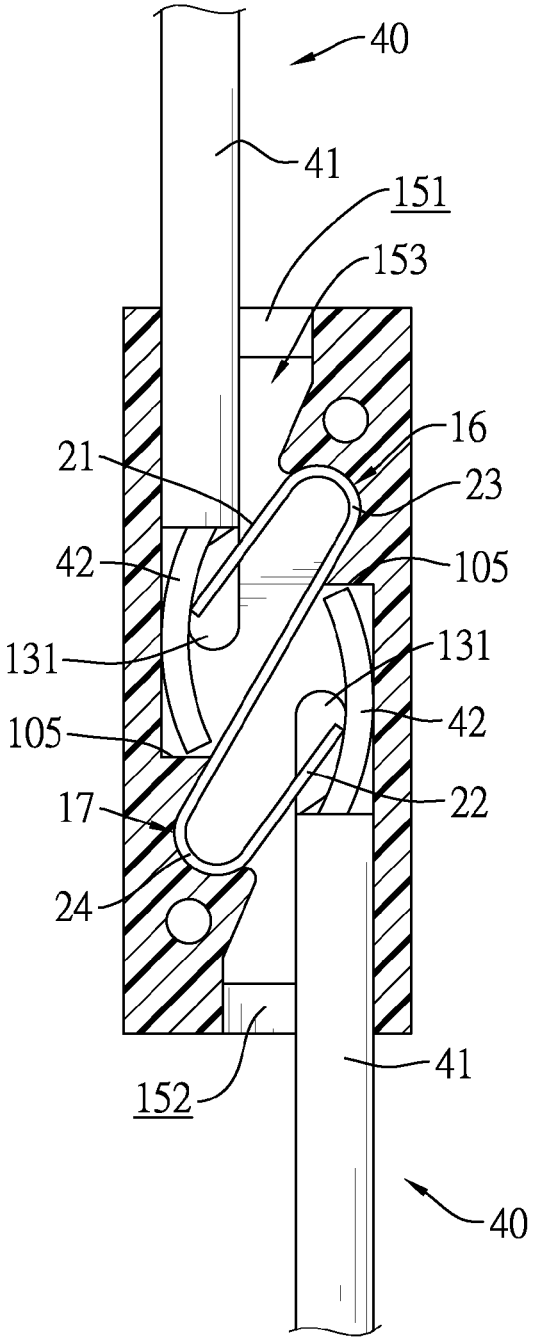
FIG. 3 is a sectional view of the first wire connector in the first embodiment of the present invention.

With reference to FIG. 1 and FIG. 3 showing a first embodiment of the fast wire connector of the present invention, the fast wire connector includes a body 10 and a conductive sheet 20. The body 20 is a hollow body and includes a top surface 11, a bottom surface 12, a front side surface 13 and a rear side surface 14. The top surface 11 and the bottom surface 12 are disposed at two ends of the body 10, and the front surface 13 and the rear surface 14 are disposed at two sides of the body 10. A connecting space 15, a top housing chamber 16 and a bottom housing chamber 17 are formed within the body 10. The connecting space 15 includes a top hole 151, a bottom hole 152, and a housing chamber 153. The top hole 151 and the bottom hole 152 are respectively formed through the top surface 11 and the bottom surface 12, and the housing chamber 153 communicates with the top hole 151 and the bottom hole 152. Two stopper portions 105 are formed on the inner surface of the body 10 adjacent to the top housing chamber 16 and the bottom housing chamber 17 respectively. The two stopper portions 105 have two stopper surfaces respectively corresponding to the top hole 151 and the bottom hole 152.

Figure 2:
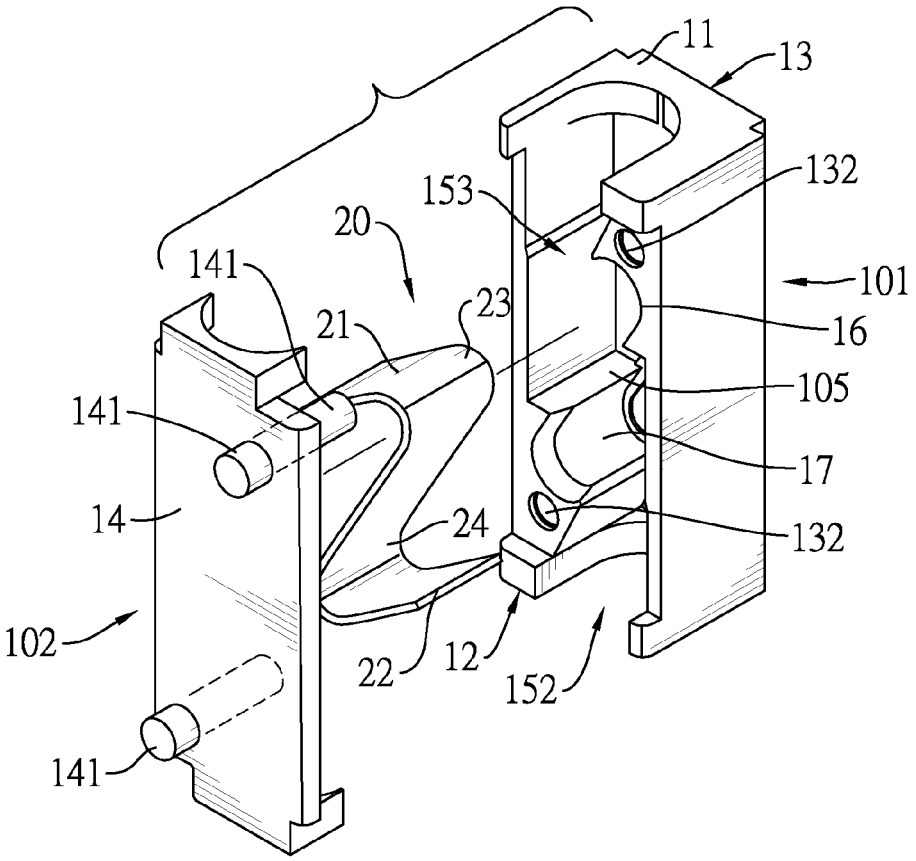
FIG. 2 is an exploded perspective view of the fast wire connector in the first embodiment of the present invention.

With reference to FIG. 2, the body 10 comprises a first assembly 101 and a second assembly 102 capable of being coupled to each other. The first assembly 101 can be a shell and the second assembly 102 can be a cover. The connecting space 15 is formed between the shell and the cover. The front side surface 13 is included in the first assembly 101 and the rear side surface 14 is included in the second assembly 102. The top housing chamber 16 and the bottom housing chamber 17 are curved concavities and are respectively adjacent to the top surface 11 and the bottom surface 12.

The conductive sheet 20 is disposed within the housing chamber 153 of the connecting space 15. The conductive sheet 20 is a metal slim sheet shaped into S shape. The conductive sheet 20 is formed by bending two ends of a rectangular sheet and sequentially includes a top contact portion 21, a top bending portion 23, a bottom bending portion 24, and a bottom contact portion 22. The top contact portion 21 connects with the top bending portion 23, and the bottom contact portion 22 connects with the bottom bending portion 24. The top bending portion 23 is inserted into the top housing chamber 16 and contacts an inner surface of the body. The bottom bending portion 24 is inserted into the bottom housing chamber 17 and contacts the inner surface of the body 10. The top contact portion 21 and the bottom contact portion 22 respectively contact opposite inner surfaces of the body 10. An elongate through-hole 131 is extendedly formed on the front side surface 13 at a position corresponding to the top contact portion 21. Another elongate through-hole 131 is extendedly formed on the front side surface 13 at a position corresponding to the bottom contact portion 22.

With reference to FIG. 1 and FIG. 3, the present invention can provide two electrical wires 40 respectively inserted into the top hole 151 and the bottom hole 152, so the two electrical wires 40 can be electrically connected to each other. The electrical wire 40 includes an insulating portion 41 and a wire conductor insulated by the insulating portion 41. The wire conductor has a terminal as a conductive portion 42 uncovered by the insulating portion 41. When the two electrical wires 40 are respectively inserted into the top hole 151 and the bottom hole 152, the two conductive portions 42 of the two electrical wires 40 pushes down the top contact portion 21 and the bottom contact portion 22 and are positioned by contacting the stopper portions 105. Two ends of the top contact portion 21 and the bottom contact portion 22 respectively work with the inner surface of the body 10 to hold the conductive portion 42 of the electrical wire 40. Therefore, the two electrical wires 40 are assembled together and cannot be departed from each other. The two electrical wires 40 are electrically connected by contacting the conductive sheet 20 so as to achieve a fast wiring purpose. It should be noted that at a distance between the stopper portion 105 corresponding to the top hole 151 and the top surface 11 or a distance between the stopper portion 105 corresponding to the bottom hole 152 and bottom surface 12 includes a certain length to let a portion of the insulating portion 41 of the conductive portion 42 be disposed within the housing chamber 153. The length of a portion of the insulating portion 41 is longer than 4 mm. Therefore, when the electrical wire 40 is implemented in the present invention, the conductive portion 42 is completely covered by the body 10 and will not be located at the exterior of the housing chamber 153 to cause power leakage problem.

Figure 4:
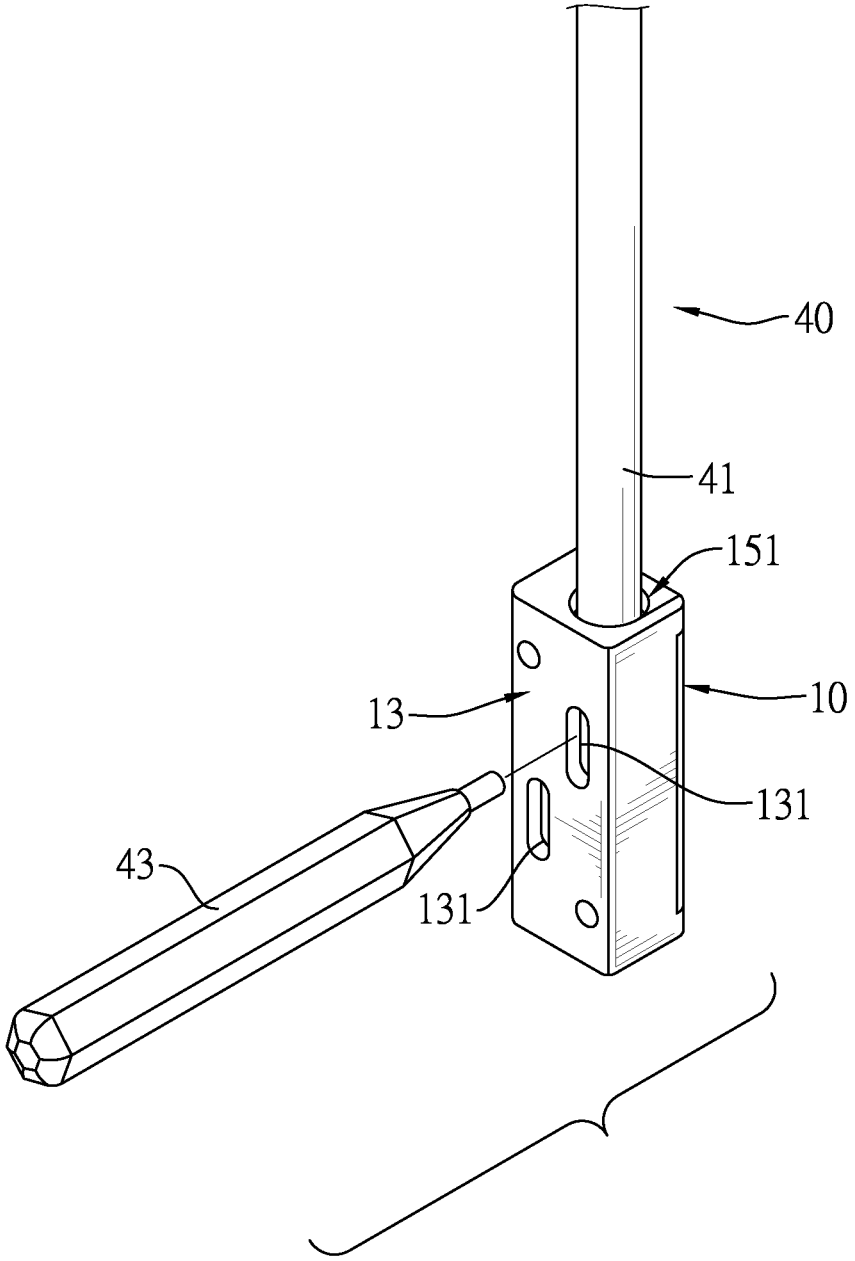
FIG. 4 and FIG. 5 are operational schematic views of a pencil-like tool inserted into the fast wire connector in the present invention.
Figure 5:
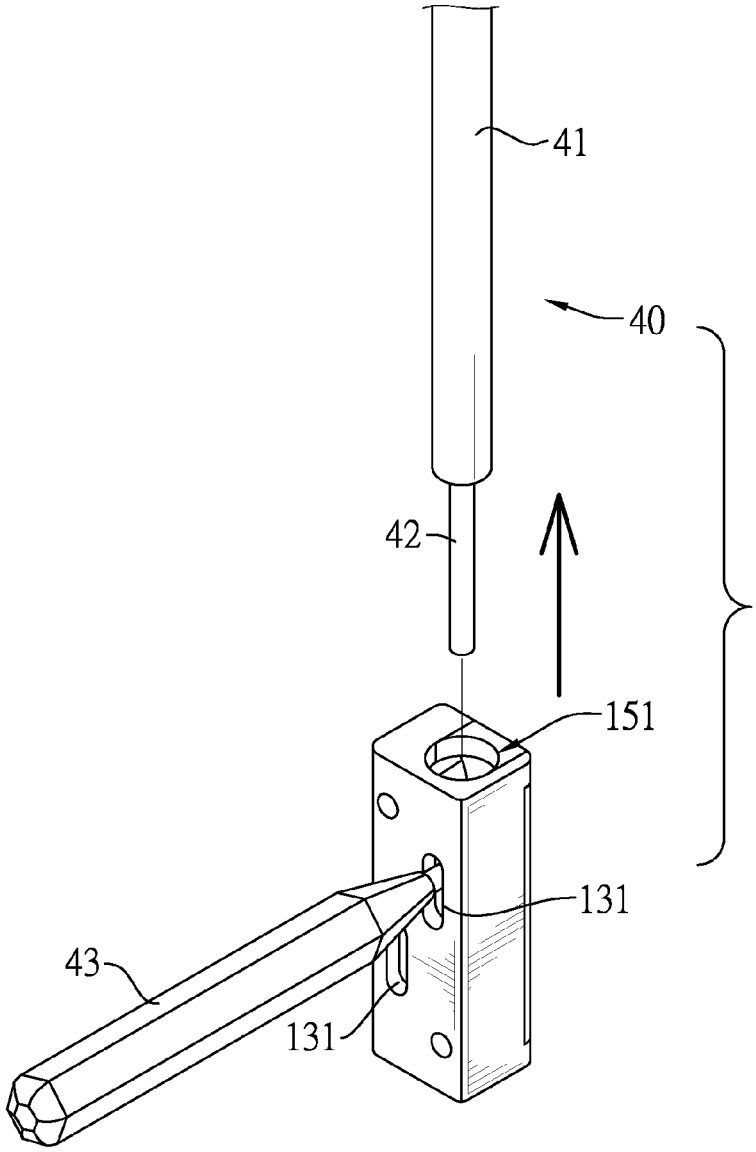

With reference to FIG. 3 to FIG. 5, when the electrical wire 40 is plugged into the top hole 151, a pencil-like tool 43 is inserted into a top edge of the elongate through-hole 131 on the front side surface 13. A front end of the pencil-like tool 43 contacts a top of the top contact portion 21. Afterwards, the pencil-like tool 43 is pulled down as shown in FIG. 5 and the front end of the pencil-like tool 43 pushes down the top contact portion 21. Therefore, the electrical wire 40 is no longer held between the front end of the top contact portion 21 and the inner surface of the body 10. The electrical wire 40 is easy to be released from the connector and the purpose to fast dissemble the electrical wire is achieved.

Figure 6:
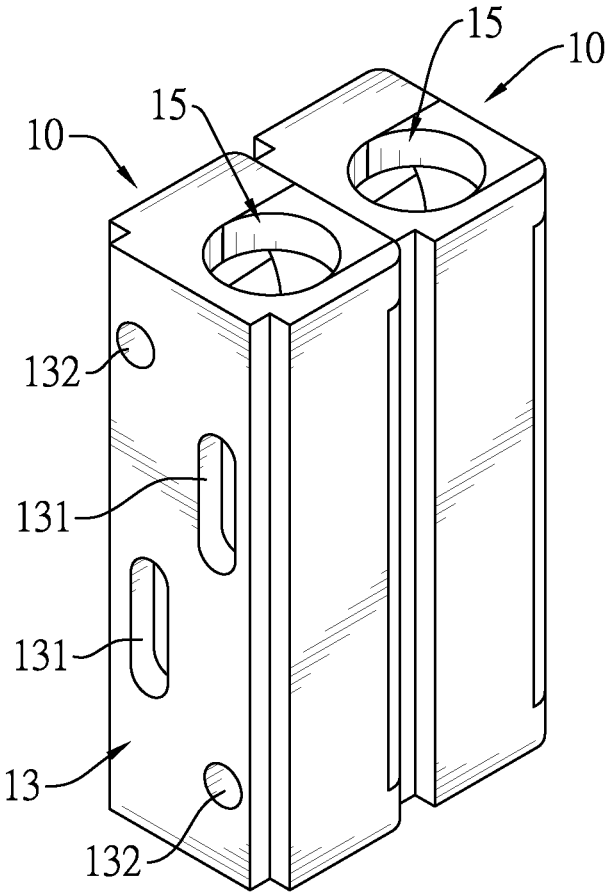
FIG. 6 is an exploded perspective view of two fast wire connectors assembled together in the present invention.

With reference to FIG. 1, FIG. 2 and FIG. 6, the first assembly 101 includes a front side surface 13, and two passing holes 132 are formed on the front side surface 13. The two passing holes 132 are respectively adjacent to the top housing chamber 16 and the bottom housing chamber 17 and are formed through the first assembly 101. The second assembly 102 includes a rear side surface 14, and two assembling components 141 are formed on the rear side surface 14. The two assembling components 141 are inserted into the corresponding passing holes 132 to assemble the first assembly 101 and the second assembly 102. Moreover, in a different embodiment, the assembling components 141 are formed at two side wall surfaces of the rear side surface 14 and corresponding to the positions of the passing holes 132. As shown in FIG. 2, the two assembling components 141 of the fast wire connector at left hand side can be inserted into the two passing holes 132 of the fast wire connector at right hand side to assemble the connector. Therefore, the assembling structure can be used to extend the fast wire connector in the present invention.

Figure 7:
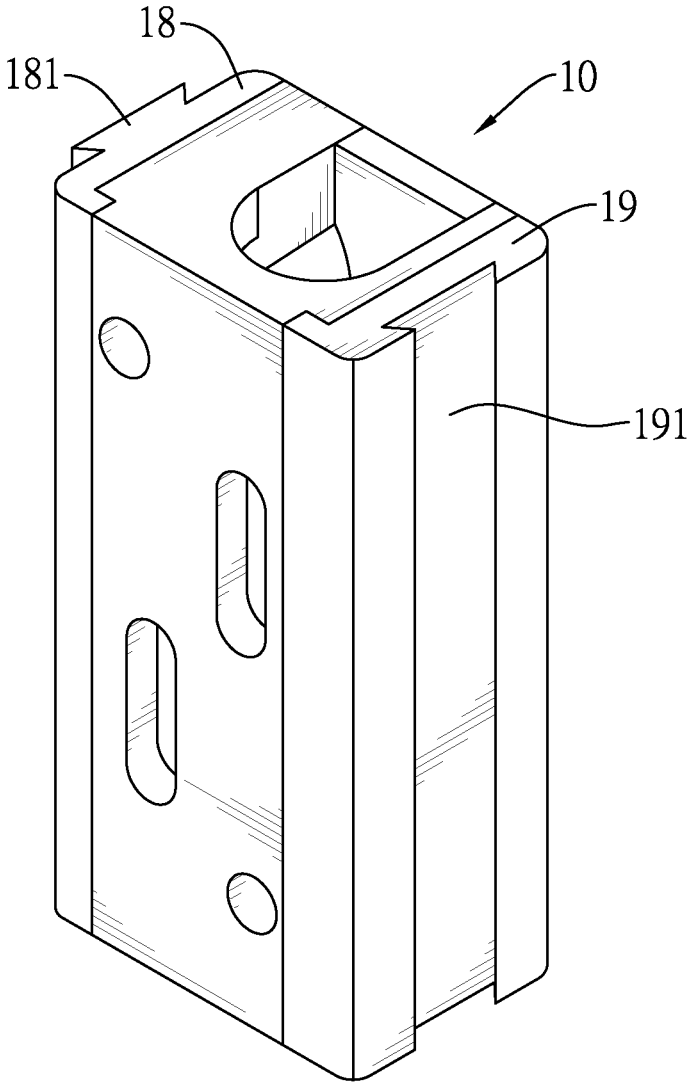
FIG. 7 is a perspective view of a dovetail joint and a dovetail slot at two side surfaces of the fast wire connector in the present invention.
Figure 8:
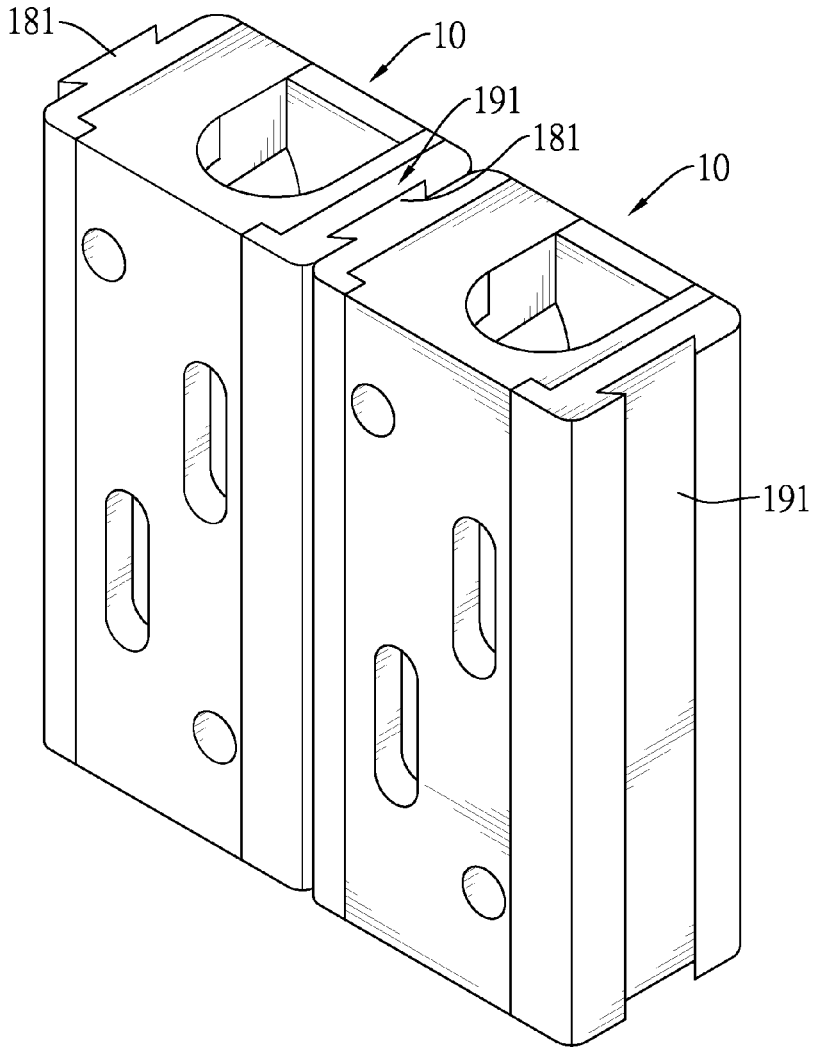
FIG. 8 is a perspective view of the two fast wire connectors assembled together by the dovetail joint and the dovetail slot in the present invention.

With reference to FIG. 7 and FIG. 8, the body 10 of the fast wire connector in the present invention includes a left side surface 18 and a right side surface 19. The left side surface 18 and the right side surface 19 are disposed at two sides of the body 10. A dovetail joint 181 is formed on the left side surface 18, a dovetail slot 191 is formed on the right side surface 19, and the dovetail joint 181 can be connected with the dovetail slot 191. Therefore, the assembling structure can be used to increase the number of the fast wire connectors in the present invention.

Figure 9:
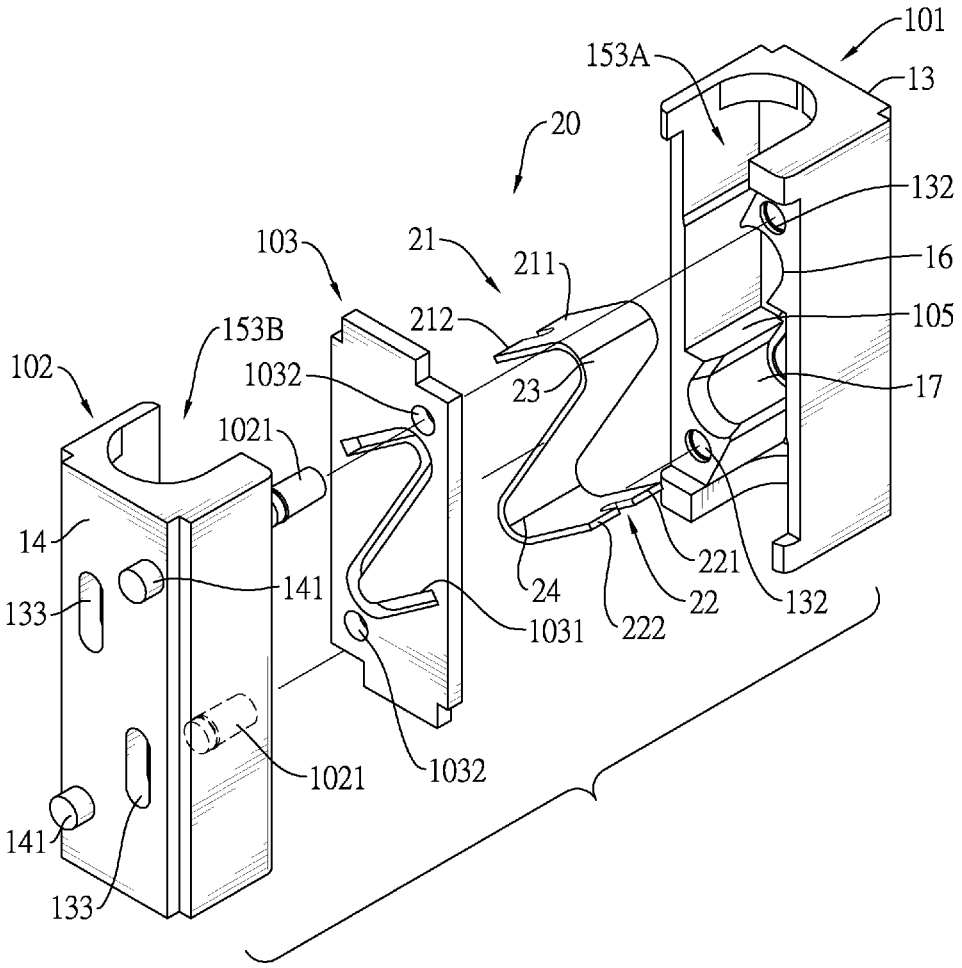
FIG. 9 is an exploded perspective view of the fast wire connector in a second embodiment of the present invention.
Figure 10:
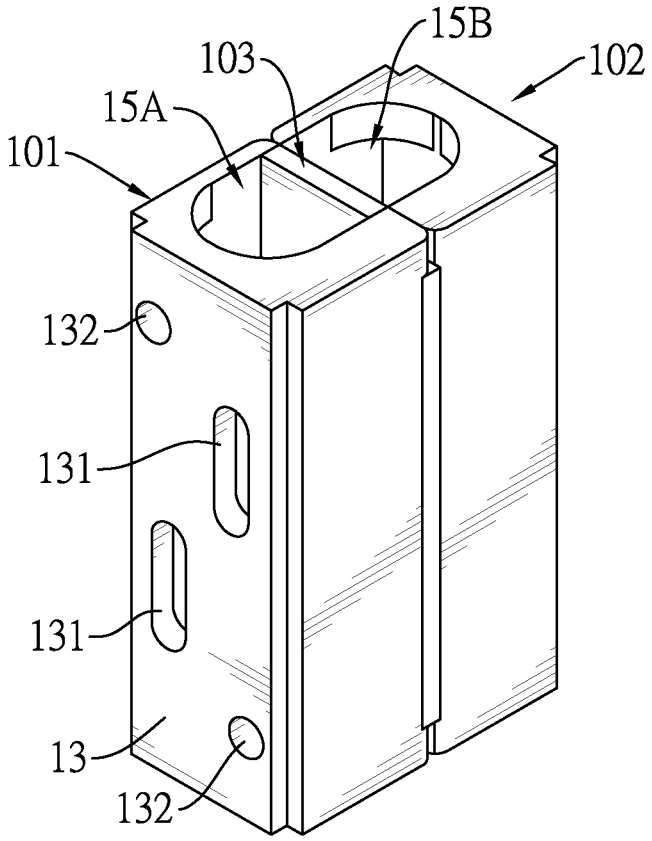
FIG. 10 is a perspective view of the fast wire connector in the second embodiment of the present invention.

FIG. 9 and the FIG. 10 show a second embodiment of the present invention. In the present embodiment, the body 10 includes a first assembly 101, a second assembly 102 and a third assembly 103. A first connecting space 15A is formed between the first assembly 101 and the third assembly 103, and a second connecting space 15B is formed between the second assembly 102 and the third assembly 103. A curved through-hole 1031 is formed on the third assembly 103 corresponding to a shape of the conductive sheet 20. The conductive sheet 20 can pass through the curved through-hole 1031. The top contact portion 21 of the conductive sheet 20 includes a first top contact portion 211 and a second top contact portion 212, and the bottom contact portion 22 includes a first bottom contact portion 221 and a second bottom contact portion 222. The first top contact portion 211 and the first bottom contact portion 221 are disposed within the housing chamber 153A of the first connecting space 15A between the first assembly 101 and the third assembly 103, and contact the inner surface of the first assembly 101. The second top contact portion 212 and the second bottom contact portion 222 are disposed within the housing chamber 153B of the second connecting space 15B between the second assembly 102 and the third assembly 103, and contact the inner surface of the second assembly 102. The top bending portion 23 of the conductive sheet 20 is inserted into the top housing chamber 16, and the bottom bending portion 24 is inserted into the bottom housing chamber 17. Two passing holes 132 are formed on the first assembly 101 and the two passing holes 132 are respectively close to the top housing chamber 16 and the bottom housing chamber 17 and are formed through the first assembly 101. Two through holes 1032 are formed on the third assembly 103 at positions corresponding to the two passing holes 132. Two engaging components 1021 are formed at positions on the second assembly 102 corresponding to the passing holes 132. The two engaging components 1021 can pass through the two through holes 1032 and engage in the two passing holes 132 so as to assemble the second assembly 102, the third assembly 103 and the first assembly 101 together to be the body 10.

Moreover, in the present embodiment, the first assembly 101 includes the front side surface 13, and the two elongate through-holes 131 are formed at positions respectively corresponding to the first top contact portion 211 and the first bottom contact portion 221. The second assembly 102 includes the rear side surface 14 and the two elongate through-holes 133 are formed at positions respectively corresponding to the second top contact portion 212 and the second bottom contact portion 222. The fast wire connector in the embodiment can provide four electrical wires to be inserted into the connector, such that the four electrical wires are electrically connected to each other in the connector. The pencil-like tool 43 can alternatively be inserted into the two elongate through-holes 131 or the two elongate through-holes 133 to release the electrical wire 40 from the housing chamber 153 of the body 10 so as to achieve the purpose to fast dissemble the electrical wire 40. Similar to the first embodiment, the two assembling components 141 are formed at the positions on the rear side surface 14 corresponding to the two passing holes 132. The two assembling components 141 of the fast wire connector in the present embodiment can be inserted into the passing holes 132 on other fast wire connectors so as to achieve the assembling purpose. Therefore, the assembling structure can be used to expand the fast wire connector in the present invention.

Figure 11:
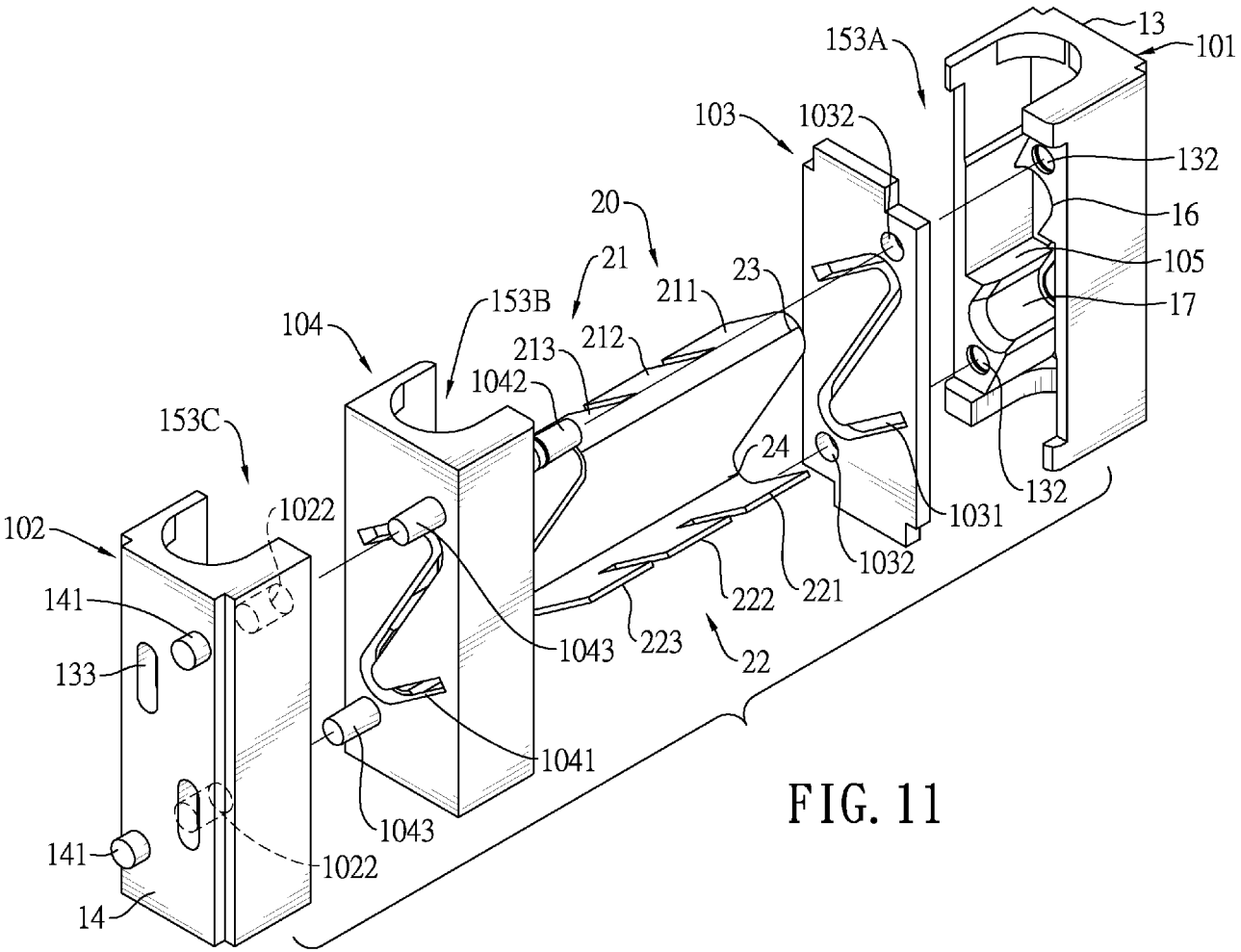
FIG. 11 is an exploded perspective view of the fast wire connector in a third embodiment of the present invention.
Figure 12:
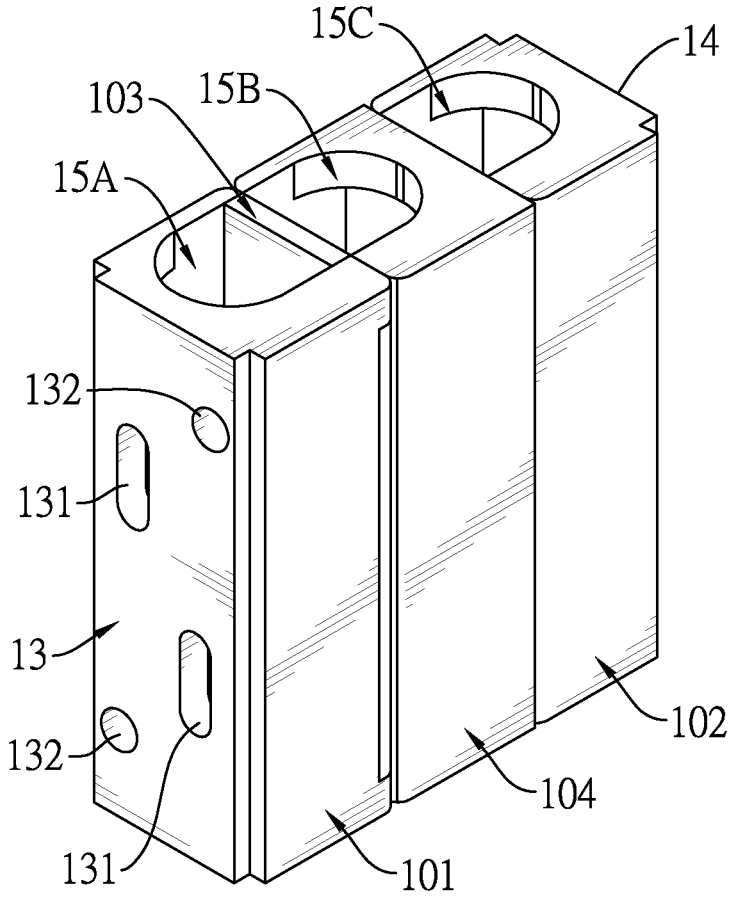
FIG. 12 is a perspective view of the fast wire connector in the third embodiment of the present invention.

With reference to FIG. 11 and FIG. 12, the body includes a first assembly 101, a second assembly 102, a third assembly 103 and a fourth assembly 104. A connecting space 15A is formed between the first assembly 101 and the third assembly 103, another connecting space 15C is formed between the second assembly 102 and the third assembly 104, and further another connecting space 15B is formed between the third assembly 103 and the fourth assembly 104. A curved through-hole 1031 is formed on the third assembly 103 corresponding to a shape of the conductive sheet 20, and a curved through-hole 1041 is formed on the fourth assembly 104 corresponding to a shape of the conductive sheet 20. The conductive sheet 20 can pass through the curved through-hole 1031 of the third assembly 103 and the curved through-hole 1041 of the fourth assembly 104.

The top contact portion 21 of the conductive sheet 20 includes a first top contact portion 211, a second top contact portion 212 and a third top contact portion 213. The bottom contact portion 22 of the conductive sheet 20 includes a first bottom contact portion 221, a second bottom contact portion 222 and a third bottom contact portion 223. The first top contact portion 211 and the first bottom contact portion 221 are disposed within the housing chamber 153A of the connecting space 15A between the first assembly 101 and the third assembly 103 and contacts the inner surface of the first assembly 101. The second top contact portion 212 and the second bottom contact portion 222 are disposed within the housing chamber 153B of the connecting space 15B between the third assembly 103 and the fourth assembly 104 and contact the inner surface of the fourth assembly 104. The third top contact portion 213 and the third bottom contact portion 223 are disposed within the housing chamber 153 C of the connecting space 15C between the second assembly 102 and the fourth assembly 104 and contact the inner surface of the second assembly 102.

The top bending portion 23 of the conductive sheet 20 is inserted into the top housing chamber 16, and the bottom bending portion 24 is inserted into the bottom housing chamber 17. Two passing holes 132 are formed on the first assembly 101. The two passing holes 132 are respectively close to the top housing chamber 16 and the bottom housing chamber 17 and are formed through the first assembly 101. Two through holes 1032 are formed at positions on the third assembly 103 corresponding to the two passing holes 132. Two engaging components 1042 are formed at positions on the second assembly 102 corresponding to the passing holes 132. The two engaging components 1042 can pass through the two through holes 1032 and engage in the two passing holes 132 so as to assemble the fourth assembly 104, the third assembly 103 and the first assembly 101 together to be the body 10. Two engaging components 1043 are formed on one side of the second assembly 102 toward the fourth assembly 104, and two engaging holes 1022 are formed on the second assembly 102 corresponding to the two engaging components 1043. The two engaging components 1043 are engaged in the two engaging holes 1022 to assemble the second assembly 102 with the fourth assembly 104. Therefore, the second assembly 102, the fourth assembly 104 and the first assembly 101 are connected together to form the body 10.

Moreover, in the present embodiment, the first assembly 101 includes the front side surface 13 and the two elongate through-holes 131 are formed at positions on the front side surface 13 respectively corresponding to the first top contact portion 211 and the first bottom contact portion 221. The second assembly 102 includes the rear side surface 14 and the two elongate through-holes 133 are formed at positions on the rear side surface 14 respectively corresponding to the third top contact portion 213 and the third bottom contact portion 223. The fast wire connector in the present invention can provide six electrical wires 40 inserted into the connector, and the six electrical wires 40 are electrically connected to each other. The pencil-like tool 43 can alternatively be inserted into the two elongate through-holes 131 or the two elongate through-holes 133 to release the electrical wire 40 from the housing chamber 153 of the body 10 so as to achieve the purpose to fast dissemble the electrical wire 40. Similar to the first embodiment, the two assembling components 141 are formed at the positions on the rear side surface 14 corresponding to the two passing holes 132. The two assembling components 141 of the fast wire connector in the present embodiment can be inserted into the passing holes 132 on other fast wire connectors so as to achieve the assembling purpose. Therefore, the assembling structure can be used to expand the fast wire connector in the present invention.

Compared with the conventional technique, the two elongate through-holes 131 are formed on the front side surface 13 of the body 10 corresponding to the conductive sheet 20 in the present invention. After the pencil-like tool 43 is inserted into a top edge of the top elongate through-hole 131 and moves downward, a front end of the pencil-like tool 43 pushes down the top contact portion 21 to release the front end of the top contact portion 21 from the inner surface of the body 10 so as to remove the electrical wire. Therefore, the purpose to fast dissemble the electrical wire 40 is achieved. In addition, a certain length exists between a stopper portion 105 and the corresponding top hole 151 or the bottom hole 152 to let a portion of the insulating portion 41 of the electrical wire 40 remain disposed within the housing chamber 153. Therefore, when the electrical wire 40 is used in the present invention, the conductive portion 42 is not exposed outside of the housing chamber 153 to cause power leakage problem. Therefore, the present invention solves the problems of wire dissembling difficulty and power leakage in the conventional art.

While the present invention has been described in terms of what are presently considered to be the most practical and preferred embodiments, it is to be understood that the present invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A fast wire connector adapted to be connected with at least two electrical wires and each one of the at least two electrical wires including an insulating portion and a wire conductor insulated by the insulating portion, the wire conductor having a terminal as a conductive portion uncovered by the insulating portion, the fast wire connector comprising:

a body being a hollow body and including:

a top surface and a bottom surface disposed at two ends of the body;

a front side surface and a rear side surface disposed at two sides of the body;

at least one connecting space having:

a top hole and a bottom hole respectively formed through the top surface and the bottom surface; and a housing chamber communicating with the top hole and the bottom hole; and at least one top housing chamber and at least one bottom housing chamber respectively adjacent to the top surface and the bottom surface, wherein the at least one connecting space, the at least one top housing chamber, and the at least one bottom housing chamber are formed within the body; and a conductive sheet disposed within the housing chamber at each of the at least one connecting space and sequentially forming at least one top contact portion, a top bending portion, a bottom bending portion, and at least one bottom contact portion;

the at least one top contact portion connected with the top bending portion;

the at least one bottom contact portion connected with the bottom bending portion;

the top bending portion inserted into the at least one top housing chamber and contacting an inner surface of the body;

the bottom bending portion inserted into the at least one bottom housing chamber and contacting the inner surface of the body; and the at least one top contact portion and the at least one bottom contact portion inserted into the inner surface of the body;

wherein an elongate through-hole is formed and extended on the front side surface at a position corresponding to the at least one top contact portion and another elongate through-hole is formed and extended on the front side surface at a position corresponding to the at least one bottom contact portion.

2. The fast wire connector as claimed in claim 1, wherein the body includes a first assembly and a second assembly capable of being connected to each other, the first assembly is a shell, and the second assembly is a cover.

3. The fast wire connector as claimed in claim 2, wherein the at least one connecting space is formed between the shell and the cover, the front side surface is included in the shell, and the rear side surface is included in the cover.

4. The fast wire connector as claimed in claim 3, wherein two passing holes are formed on the front side surface, the two passing holes respectively are formed through the first assembly, and two assembling components are formed on the rear side surface respectively corresponding to the two passing holes.

5. The fast wire connector as claimed in claim 1, wherein the body includes a first assembly, a second assembly and a third assembly, and the at least one connecting space is formed between the first assembly and the second assembly and between the second assembly and the third assembly.

6. The fast wire connector as claimed in claim 5, wherein a curved through-hole is formed on the third assembly and is corresponding to a shape of the conductive sheet, and the conductive sheet is mounted through the curved through-hole.

7. The fast wire connector as claimed in claim 6, wherein the at least one top contact portion includes a first top contact portion and a second top contact portion, and the at least one bottom contact portion includes a first bottom contact portion and a second bottom contact portion.

8. The fast wire connector as claimed in claim 7, wherein the first top contact portion and the first bottom contact portion are disposed within the housing chamber of the connecting space between the first assembly and the third assembly and contacts an inner surface of the first assembly, and the second top contact portion and the second bottom contact portion are disposed within the housing chamber of the connecting space between the second assembly and the third assembly and contacts an inner surface of the second assembly.

9. The fast wire connector as claimed in claim 5, wherein the rear side surface is included in the second assembly and an elongate through-hole is extendedly formed on the rear side surface at a position corresponding to the second top contact portion and another elongate through-hole is formed and extended on the rear side surface at a position corresponding to the second bottom contact portion.

10. The fast wire connector as claimed in claim 5, wherein the front side surface is included in the first assembly and forms two passing holes, the two passing holes are respectively formed through the first assembly, and the rear side surface is included in the second assembly and forms two assembling components respectively corresponding to the two passing holes.

11. The fast wire connector as claimed in claim 1, wherein the body includes a first assembly, a second assembly, a third assembly and a fourth assembly, and the at least one connecting space is formed between the first assembly and the third assembly, between the second assembly and the fourth assembly, and between the third assembly and the fourth assembly.

12. The fast wire connector as claimed in claim 11, wherein a curved through-hole is formed at each of the third assembly and the fourth assembly and is corresponding to a shape of the conductive sheet.

13. The fast wire connector as claimed in claim 12, wherein the at least one top contact portion includes a first top contact portion, a second top contact portion and a third top contact portion, and the at least one bottom contact portion includes a first bottom contact portion, a second bottom contact portion and a third bottom contact portion.

14. The fast wire connector as claimed in claim 13, wherein the first top contact portion and the first bottom contact portion are disposed within the housing chamber of the connecting space between the first assembly and the third assembly and contacts an inner surface of the first assembly, the second top contact portion and the second bottom contact portion are disposed within the housing chamber of the connecting space between the third assembly and the fourth assembly and contacts an inner surface of the fourth assembly, and the third top contact portion and the third bottom contact portion are disposed within the housing chamber of the connecting space between the second assembly and the fourth assembly and contacts an inner surface of the second assembly.

15. The fast wire connector as claimed in claim 13, wherein the rear side surface is included in the second assembly and the elongate through-hole is extendedly formed on the rear side surface at a position corresponding to the third top contact portion, and the elongate through-hole is extendedly formed on the rear side surface at a position corresponding to the third bottom contact portion.

16. The fast wire connector as claimed in claim 11, wherein the at least one connecting space, the top housing chamber and the bottom housing chamber are formed within the first assembly and the second assembly.

17. The fast wire connector as claimed in claim 1, wherein two stopper portions are formed on the inner surface of the body adjacent to the top housing chamber and the bottom housing chamber respectively.

18. The fast wire connector as claimed in claim 17, wherein the two stopper portions form two stopper surfaces respectively corresponding to the top hole and the bottom hole, and the electrical wire is plugged into the top hole or the bottom hole and the conductive portion of the wire contacts the corresponding stopper surface of the stopper portion.

19. The fast wire connector as claimed in claim 18, wherein a front end of the at least one contact portion and the inner surface of the body together hold the conductive portion of the electrical wire, and a portion of the insulating portion is disposed within the housing chamber and a length of the portion of the insulating portion is greater than 4 mm.

20. The fast wire connector as claimed in claim 1, wherein the body further includes a left side surface and a right side surface, the left side surface and the right side surface are located at two sides of the body between the front side surface and the rear side surface, a dovetail joint is formed on the left side surface, and a dovetail slot is formed on the right side surface.

* * * * *